US008622441B1

(12) United States Patent
Ng

(10) Patent No.: US 8,622,441 B1
(45) Date of Patent: Jan. 7, 2014

(54) HAND HELD LINK MAKING DEVICE AND KIT

(71) Applicant: Cheong Choon Ng, Novi, MI (US)

(72) Inventor: Cheong Choon Ng, Novi, MI (US)

(73) Assignee: Choon's Design LLC, Wixom, MI (US)

( * ) Notice: Subject to any disclaimer, the term of this patent is extended or adjusted under 35 U.S.C. 154(b) by 0 days.

(21) Appl. No.: 14/018,542

(22) Filed: Sep. 5, 2013

Related U.S. Application Data

(63) Continuation of application No. 13/626,057, filed on Sep. 25, 2012.

(60) Provisional application No. 61/846,270, filed on Jul. 15, 2013.

(51) Int. Cl.
*D03J 3/00* (2006.01)

(52) U.S. Cl.
USPC ..... 289/17

(58) Field of Classification Search
USPC ..... 289/2, 16.5, 17, 18.1; D21/334; 273/281, 288, 309; 66/4
See application file for complete search history.

(56) References Cited

U.S. PATENT DOCUMENTS

| | | | | | |
|---|---|---|---|---|---|
| 222,937 | A | * | 12/1879 | Newcomb | 66/4 |
| 246,648 | A | * | 9/1881 | Wilcox | 66/4 |
| 254,258 | A | | 2/1882 | Barbour | |
| 254,288 | A | | 2/1882 | Dimmick | |
| 289,578 | A | * | 12/1883 | Stewart | 66/4 |
| 782,657 | A | | 2/1905 | Hubert | |
| 843,495 | A | | 2/1907 | Sander | |
| 1,073,226 | A | | 9/1913 | Freeman | |
| 1,318,465 | A | * | 10/1919 | Seifarth | 66/4 |
| 1,318,604 | A | * | 10/1919 | Schneider | 66/4 |
| 1,366,212 | A | | 1/1921 | Pollard | |
| 1,375,119 | A | | 4/1921 | Stephen | |
| 1,424,458 | A | | 8/1922 | Fleisher | |
| 1,500,383 | A | * | 7/1924 | Gourie | 66/4 |
| 1,599,040 | A | | 9/1926 | Clisby | |
| 1,776,561 | A | | 12/1927 | La Croix | |
| 1,994,659 | A | | 3/1935 | Mascarenhas | |
| 2,108,424 | A | | 2/1938 | Bakely | |
| 2,134,066 | A | | 10/1938 | Van Ness | |
| 2,270,619 | A | | 1/1942 | Bowyer | |
| 2,318,018 | A | * | 5/1943 | Semonsen | 66/4 |
| 2,360,416 | A | | 10/1944 | Gray | |

(Continued)

FOREIGN PATENT DOCUMENTS

| | | |
|---|---|---|
| JP | 2003-520083 | 7/2003 |
| JP | 2004-520910 | 7/2004 |
| KR | 10-2001-0012609 | 2/2001 |
| KR | 10-2006-0042108 | 5/2006 |

OTHER PUBLICATIONS

International Search Report and Written Opinion for PCT Application No. PCT/US2011/041553 mailed on Feb. 23, 2012.

(Continued)

*Primary Examiner* — Shaun R Hurley
(74) *Attorney, Agent, or Firm* — Carlson, Gaskey & Olds, P.C.

(57) ABSTRACT

A disclosed device for creating an item consisting of a series of links includes at least two posts spaced part from each other in a first direction with each of the posts including a first arm and a second arm and an access slot.

16 Claims, 5 Drawing Sheets

(56) References Cited

U.S. PATENT DOCUMENTS

| | | | | | |
|---|---|---|---|---|---|
| 2,457,064 | A | * | 12/1948 | Parisl | 66/4 |
| 2,545,409 | A | | 3/1951 | McCall | |
| 2,658,364 | A | * | 11/1953 | Carlson | 66/4 |
| 2,687,630 | A | * | 8/1954 | Carlson | 66/117 |
| 2,703,482 | A | | 3/1955 | Auran | |
| 3,069,739 | A | | 12/1962 | Jorgenson et al. | |
| 3,377,674 | A | | 4/1968 | Brassaw et al. | |
| 3,438,098 | A | | 4/1969 | Grabner | |
| 3,476,423 | A | | 11/1969 | Kentfield | |
| 3,636,987 | A | | 1/1972 | Forby | |
| 3,648,484 | A | * | 3/1972 | Gordon | 66/4 |
| 3,665,971 | A | | 5/1972 | Ileks | |
| 3,672,679 | A | | 6/1972 | Burns | |
| 3,678,709 | A | | 7/1972 | Nowicki et al. | |
| 3,688,357 | A | | 9/1972 | Nielsen et al. | |
| 3,728,762 | A | | 4/1973 | Hogg | |
| 3,748,706 | A | | 7/1973 | Doyel | |
| 3,805,345 | A | | 4/1974 | Antos | |
| 4,032,179 | A | | 6/1977 | Goss | |
| 4,114,892 | A | | 9/1978 | Csoka | |
| 4,179,129 | A | | 12/1979 | Loomis | |
| 4,416,040 | A | * | 11/1983 | Towsley | 28/152 |
| 4,569,108 | A | | 2/1986 | Schwab | |
| 4,629,100 | A | | 12/1986 | Owens | |
| 4,667,965 | A | | 5/1987 | Helms, Jr. | |
| D330,668 | S | | 11/1992 | Nagamatsu | |
| 5,163,946 | A | | 11/1992 | Li | |
| 5,231,742 | A | | 8/1993 | Macbain | |
| 5,295,280 | A | | 3/1994 | Hudson et al. | |
| 5,328,374 | A | | 7/1994 | Stevens | |
| 5,437,459 | A | | 8/1995 | Kirby | |
| 5,459,905 | A | | 10/1995 | Voyre | |
| 5,577,299 | A | | 11/1996 | Thompson et al. | |
| 5,639,090 | A | | 6/1997 | Stevens | |
| 5,687,775 | A | | 11/1997 | Thompson et al. | |
| 5,713,094 | A | | 2/1998 | Markey et al. | |
| 5,927,764 | A | | 7/1999 | Harriman | |
| 6,065,968 | A | | 5/2000 | Corliss | |
| 6,122,859 | A | | 9/2000 | Lazar | |
| 6,129,551 | A | | 10/2000 | Martin | |
| 6,146,144 | A | | 11/2000 | Fowler et al. | |
| 6,171,317 | B1 | | 1/2001 | Jackson et al. | |
| 6,880,364 | B1 | | 4/2005 | Vidolin et al. | |
| 6,923,026 | B1 | | 8/2005 | Clarke | |
| D570,923 | S | | 6/2008 | Vazquez Gastellu | |
| 7,506,524 | B2 | | 3/2009 | Gustin | |
| 7,578,146 | B2 | | 8/2009 | Gustin | |
| 7,909,609 | B2 | | 3/2011 | Molin | |
| 8,316,894 | B2 | | 11/2012 | Schaub | |
| 8,402,794 | B2 | * | 3/2013 | Sasur | 66/3 |
| 8,485,565 | B2 | * | 7/2013 | Ng | 289/17 |
| 2008/0156043 | A1 | * | 7/2008 | Gustin | 66/4 |
| 2008/0223083 | A1 | * | 9/2008 | Gustin | 66/1 A |
| 2009/0215013 | A1 | | 8/2009 | Molin | |
| 2010/0019495 | A1 | | 1/2010 | Oliveto | |
| 2011/0152946 | A1 | | 6/2011 | Frigg et al. | |
| 2012/0047960 | A1 | * | 3/2012 | Sasur | 66/1 A |
| 2012/0112457 | A1 | * | 5/2012 | Ng | 289/1.5 |
| 2013/0020802 | A1 | * | 1/2013 | Ng | 289/1.5 |
| 2013/0300114 | A1 | * | 11/2013 | Ng | 289/1.5 |

OTHER PUBLICATIONS

International Preliminary Report on Patentability for PCT Application No. PCT/US2011/041553 mailed May 16, 2013.

* cited by examiner

HAND HELD LINK MAKING DEVICE AND KIT

CROSS REFERENCE TO RELATED APPLICATION

This application is a continuation of U.S. application Ser. No. 13/626,057 filed Sep. 25, 2012, and claims priority to U.S. Provisional Application Ser. No. 61/846,270 filed on Jul. 15, 2013.

BACKGROUND

This disclosure generally relates to method and device for creating a linked item. More particularly, this disclosure relates to a method and device for creating a linked wearable item from elastic bands.

Kits that include materials for making a uniquely colored bracelet or necklace have always enjoyed some popularity. However such kits usually just include the raw materials such as different colored threads and beads and rely on the individual's skill and talent to construct a usable and desirable item. Accordingly there is a need and desire for a kit that provides not only the materials for creating a unique wearable item, but also that simplifies construction to make it easy for people of many skill and artistic levels to successfully create a desirable and durable wearable item.

SUMMARY

A Brunnian link is a link formed from a closed loop doubled over itself to capture another closed loop to form a chain. Elastic bands can be utilized to form such links in a desired manner. The example kit and device provides for creation of Brunnian and other linked articles. Moreover, the example kit provides for the successful creation of unique wearable articles using Brunnian and other link assembly techniques.

The example kit includes a template for mounting an initial band and a hook utilized for attaching additional bands to the initial bands placed on the template. The template includes pins that hold the initial band in place while additional bands are linked onto each other. The kit further includes a clip utilized to attach ends once the desired length is formed.

These and other features disclosed herein can be best understood from the following specification and drawings, the following of which is a brief description.

DETAILED DESCRIPTION

Figure 2:
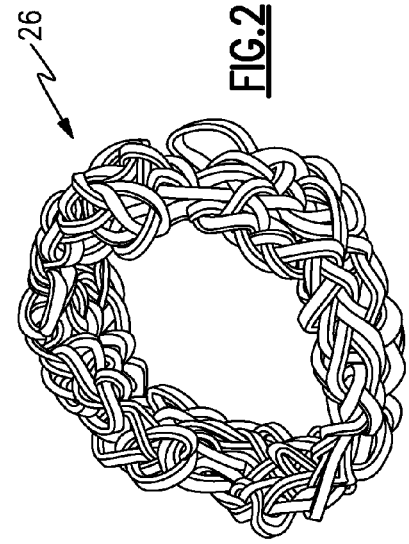
FIG. 2 is schematic view of link article.
Figure 1:
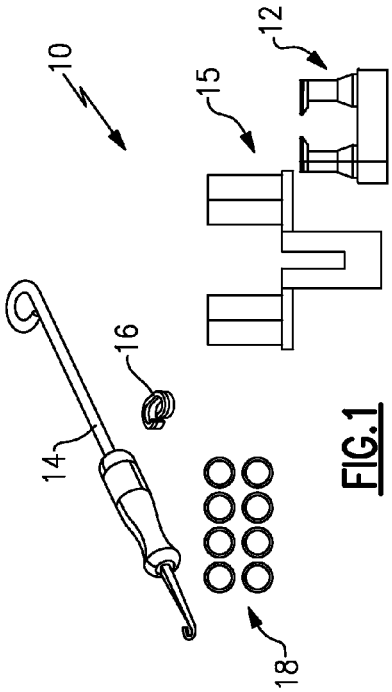
FIG. 1 perspective view of an example kit for creating a linked article.

Referring to FIGS. 1 and 2, an example kit is indicated at 10 for creating linked items such as bracelets, necklaces and other wearable or decorative article as generally indicated in FIG. 2. The example kit 10 includes a template 12, a clip 16 and a hook 14. The example kit 10 also includes a number of elastic members 18 that are used with the kit 10 to form links for the resulting wearable article. The elastic members 18 are consumed as articles are fabricated, and are replaced and replenished with additional elastic members. Moreover, the example elastic members 18 are of a size corresponding with the example template 12. Further, although a single clip 16 is illustrated, the example kit 10 will include many clips 16 to provide for the fabrication of many articles 26.

Figure 3:
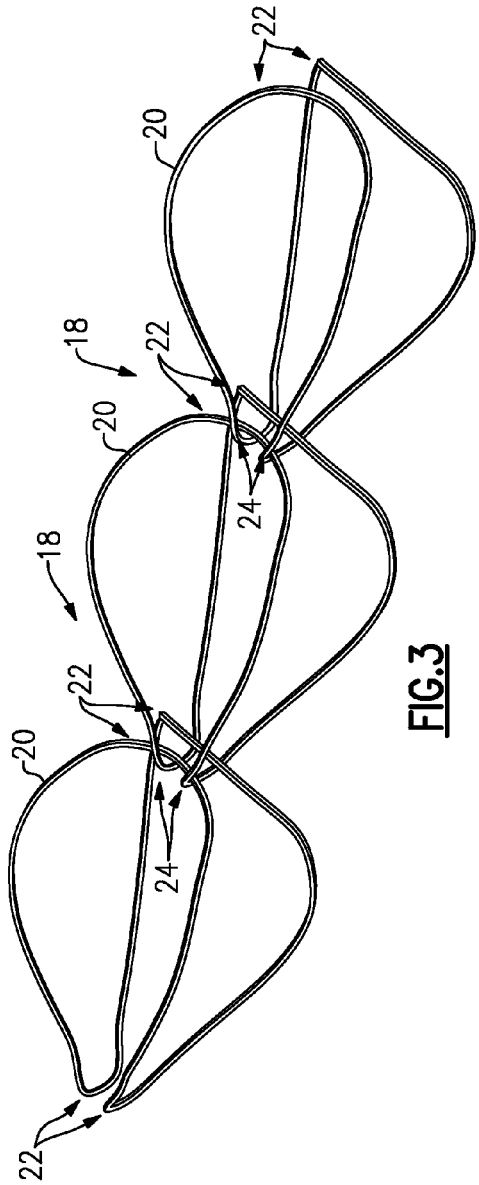
FIG. 3 is a schematic view of a series of a series of Brunnian links.

Referring to FIG. 3, a Brunnian link 20 is formed from a continuous looped structure without forming an actual knot. Several links 20 are formed in a chain to form a circular structure. Ends 22 of each elastic member 18 are secured and a durable wearable article is created. In this example three links 20 are shown forming a single chain. Each link 20 is formed by capturing the ends 22 of one loop structure with a mid portion 24 of another loop structure in series. Each link 20 depends on the previous and subsequent links 20 to maintain the desired shape and integrity. Removing one link 20 results in all of the links becoming loose from each other.

Figure 4:
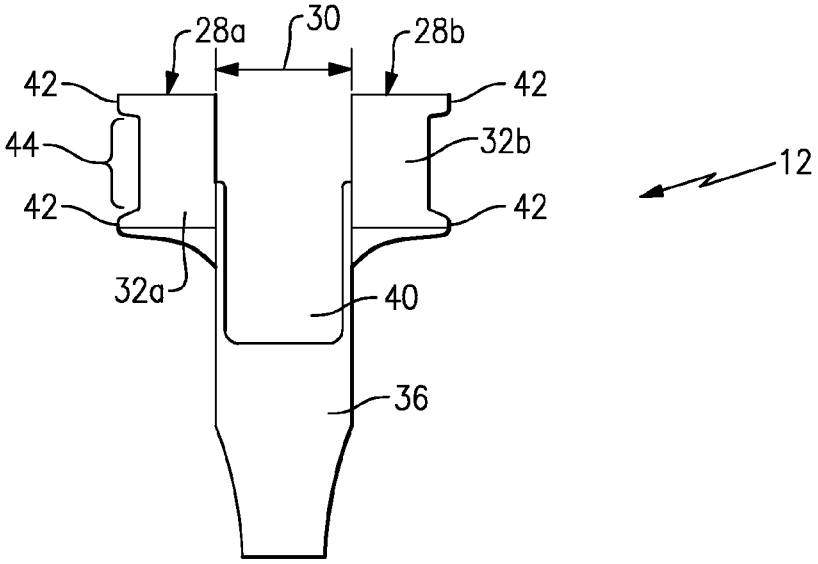
FIG. 4 is a side view of an example template.
Figure 5:
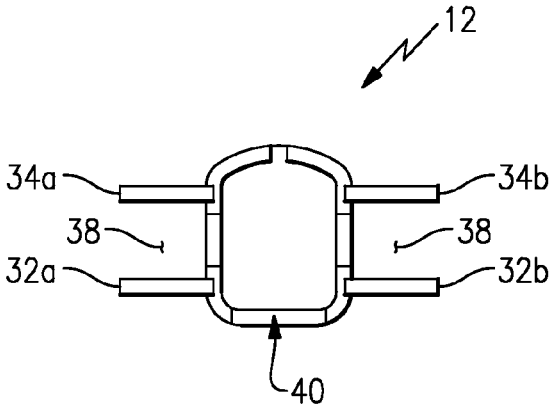
FIG. 5 is an end view of the example template.
Figure 6:
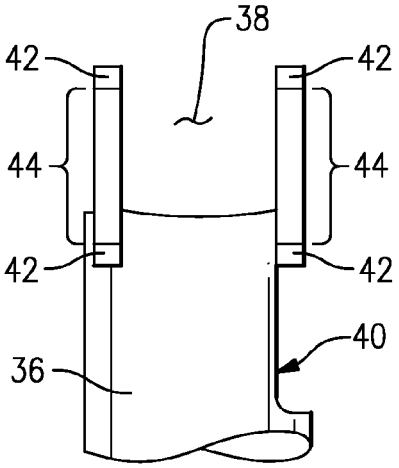
FIG. 6 is a top view of the example template.

Referring to FIGS. 4, 5 and 6, the example template 12 includes two posts 28A, 28B spaced a distance 30 apart from each other. Each of the pins 28A, 28B includes a first arm 32*a-b* and second arm 34*a-b* supported on a base 36. The arms 32*a-b*, 34*a-b* defines an access slot 38 that extends across both of the posts 28A, 28B. The base 36 includes a link opening 40 for completed links of a linked article during fabrication. Each of the first and second arms 32*a-b*, 34*a-b* include upper and lower tabs 42 that maintain a linked article within a center section 44.

Figure 7:
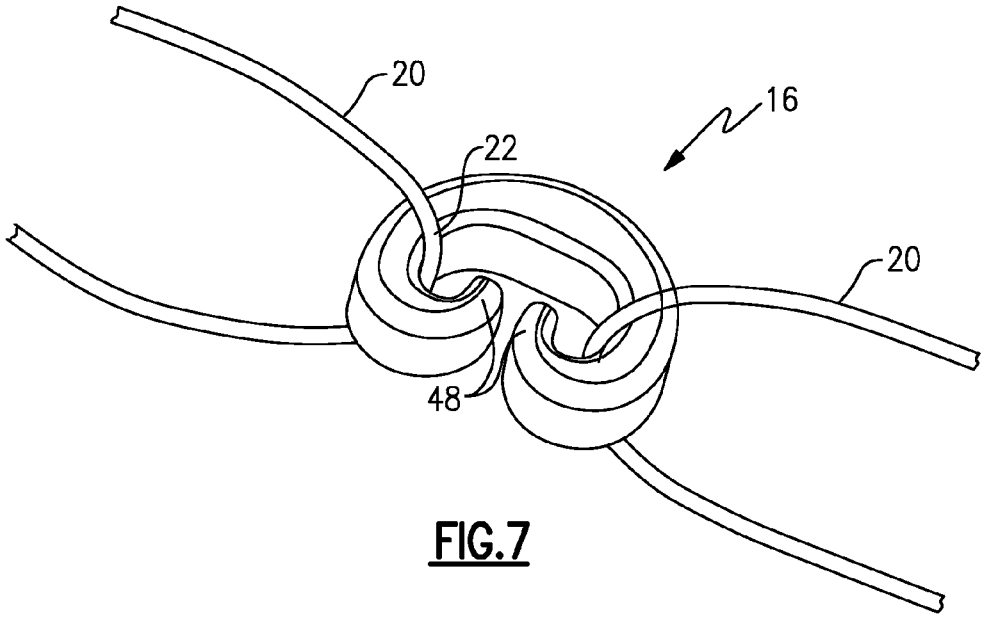
FIG. 7 is a plan view of an example clip for securing loose ends of a Brunnian linked article.
Figure 8:
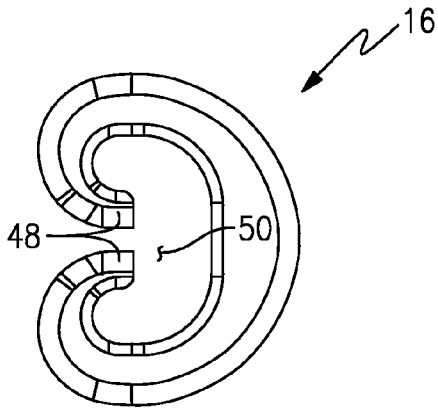
FIG. 8 is perspective view illustrating elastic bands secured with the example clip.

Referring to FIGS. 7 and 8, the example clip 16 is generally C-shaped with inwardly facing ends 48. The inwardly facing ends 48 point inwardly to an open space 50 where parts of the elastic members are kept 18. The inwardly facing ends 48 prevent ends 22 from sliding out from the inner area 50 off of the clip 16.

Referring to FIGS. 9A-M, the example template 12 is utilized for the formation of a linked article. As appreciated, elastic bands 18 can be difficult to manipulate and hold during the construction of a desired article. The example template 12 provides for holding of an initial number of links 20 and subsequent connection of each link in the linked article. The template 12 includes the first and second posts 28A, 28B along with the access slot 38 across both of the posts 28A-B. The specific linked configuration can be a simple Brunnian link, but may also be more complex and intricate link structures such as a fishbone type link structure. The template 12 includes the link opening 40 to facilitate the fishbone link structure where the linked article grows and extends from the template 12 through the link opening 40.

Figure 9A:
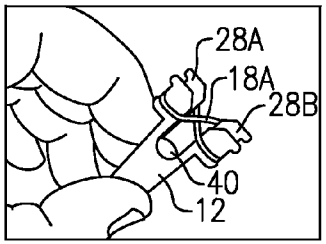
FIGS. 9A-9M are views of an example method of creating a linked article using the example template and kit.
Figure 9B:
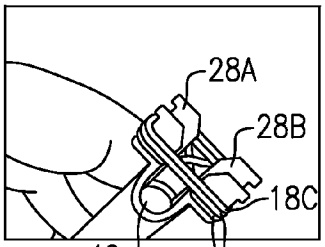

The Figures illustrate formation of a fishbone linked structure utilizing the example template 12. The initial step illustrated in FIG. 9A includes assembling a first elastic band 18A by crossing over itself to form a FIG. 8 pattern across the posts 28*a-b*. A second elastic band 18B and third elastic band 18C is then assembled over the first elastic band 18A without crossing over as is shown in FIG. 9B. Three elastic bands are therefore supported across the posts 28*a-b* with the first band 18A on the bottom below the second and third elastic bands 18B, 18C.

Figure 9C:
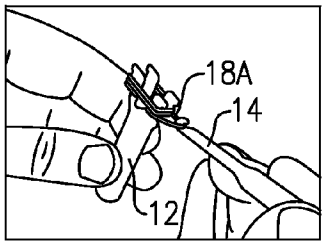
Figure 9D:
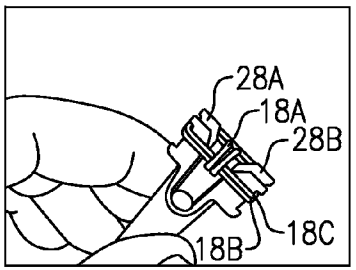

Utilizing the hook tool 14, the bottom, lower most, or first elastic band 18A is pulled off of the posts 28A-B and looped over the second and third elastic bands 18B, 18C as is shown in FIGS. 9C and 9D. The first elastic band 18A is positioned to loop around each of the second and third elastic bands 18B, 18C and is not supported directly by the posts 28*a-b*.

Figure 9E:
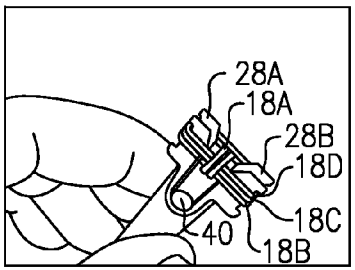

An additional elastic band 18D is then added above the second and third elastic bands 18B, 18C such that the second elastic band 18B is now the lower most elastic band as is shown in FIG. 9E. The lower most elastic band 18B is then grasped with the hook tool 14 (FIG. 9F) by extending the hook tool 14 into the access slot 38 and grasping ends of the elastic band in sequence, pulling the ends away from the corresponding post (FIG. 9G) and looping each end over onto the and around the other links supported between the first and second posts as is shown in FIG. 9H.

Figure 9F:
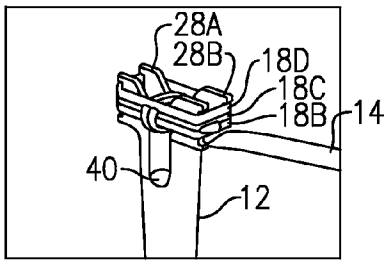
Figure 9G:
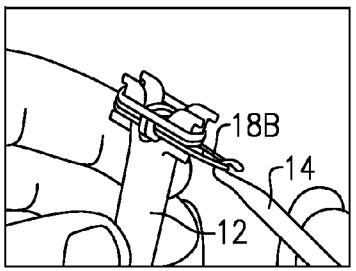
Figure 9H:
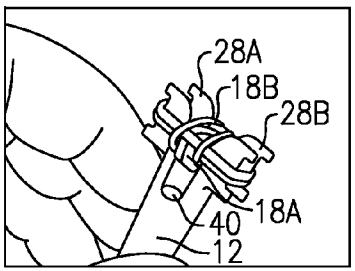
Figure 9I:
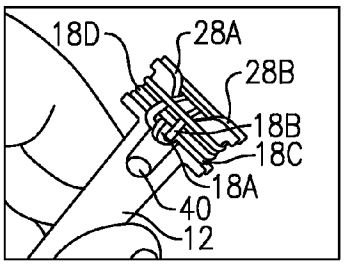
Figure 9J:
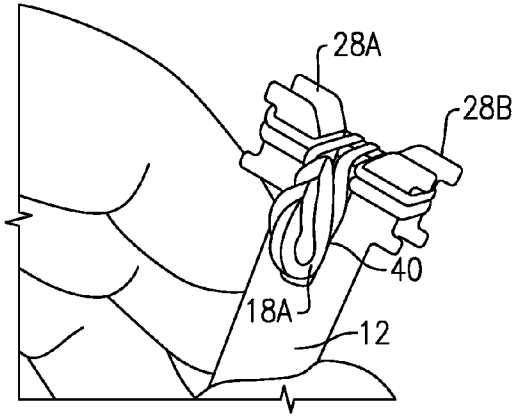
Figure 9K:
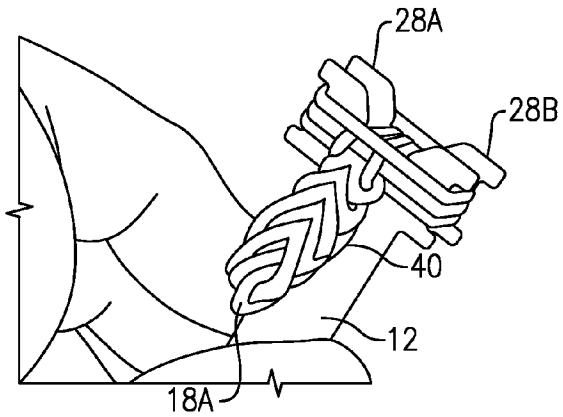
Figure 9L:
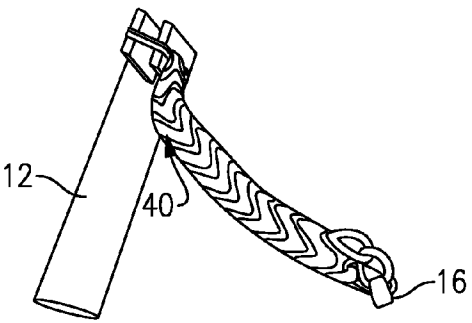

An additional link is added above the two remaining links 18C, 18D across the two posts 28*a-b* as is shown in FIG. 9I and the process shown in FIGS. 9F through 9H is repeated with additional links to grow the length of the linked structure as is shown in FIGS. 9J and 9K until a desire length or number of links are connected to each other as is illustrated in FIG. 9L.

Figure 9M:
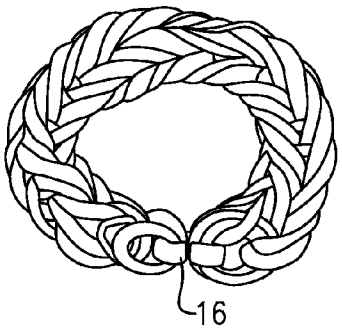

Once the desired length is achieved, as the example in FIG. 9L illustrates a clip 16 is attached to the end elastic link. The remaining links on the posts 28*a-b* can be removed and attached to the clip 16 to form the completed linked article as is shown in FIG. 9M. As appreciated although the ends are connected to form the example linked article. The linked article may have terminal ends that are separately terminated to provide a length of a linked article.

Accordingly, the example kit and method provide for the creation of many different combinations and configurations of linked structures and articles for the creation of bracelets, necklaces, and other wearable items. Moreover, the example kit is expandable to further create and expand the capabilities of potential linked structures and articles. Further, the example kit provides for the creation of such links and items in an easy manner allowing persons of varying skill levels to be successful in creating unique wearable items.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A device for creating an item consisting of a series of links, the device comprising:

at least two posts spaced part from each other in a first direction, wherein each of the posts include a first arm and a second arm and an access slot disposed therebetween, wherein each of the first arm and the second arm include upper and lower tabs for holding the links on the corresponding first arm and second arm.

2. The device as recited in claim 1, including a base supporting the at least two posts.

3. The device as recited in claim 1, including a link opening disposed within the base and between the at least two posts providing a space for completed links during fabrication of a linked article.

4. The device as recited in claim 1, wherein the access slot is aligned across the first arm and the second arm.

5. The device as recited in claim 1, wherein the tabs are spaced horizontally apart from each other.

6. A method of creating a linked item comprising the steps of:

assembling a first elastic band across at least two posts of a template;

assembling at least one additional elastic band across the at least two posts above the first elastic band;

looping a first and a second end of the first elastic band over the at least one additional elastic band and off of the at least two posts;

adding at least one additional elastic band;

looping a first end and a second end of the bottom elastic band over the added elastic band; and adding elastic bands and looping corresponding first and second ends of the bottom band over the added elastic band to obtain a desired number of links.

7. The method as recited in claim 6, wherein looping comprises grasping one of the first and second ends of the elastic bands with a hook tool and pulling the end over additional elastic bands.

8. The method as recited in claim 7, including extending the hook tool into a space defined within each of the at least two posts for grasping one of the first and second ends of the elastic bands.

9. The method as recited in claim 6, including extending linked ones of the elastic bands out an opening within a base supporting the at least two posts.

10. The method as recited in claim 7, including securing ends of the linked article with a clip by inserting ends of the elastic bands into a clip to form the linked item.

11. A kit for creating an item consisting of a series of links, the kit comprising:

a template including at least two posts spaced part from each other in a first direction, wherein each of the posts include an access slot defined between a first arm and a second arm; and at least one clip including inward facing ends disposed on each side of an opening for securing ends of the series of links together.

12. The kit as recited in claim 11, including a base supporting the at least two posts.

13. The kit as recited in claim 11, including a link opening disposed within the base and between the at least two posts providing a space for completed links to during fabrication of a linked article.

14. The kit as recited in claim 11, wherein the clip comprises a C-shape and the inward facing ends extend in a direction perpendicular to the opening.

15. The kit as recited in claim 11, including a hook for manipulating elastic members relative to each other.

16. The kit as recited in claim 11, including a plurality of elastic members for forming the series of links.

* * * * *